US010760867B2

(12) United States Patent
Davis et al.

(10) Patent No.: US 10,760,867 B2
(45) Date of Patent: Sep. 1, 2020

(54) ACTUATABLE MUZZLE BRAKE FOR A FIREARM

(71) Applicants: Bradley Davis, Rathdrum, ID (US); William Tincup, Rathdrum, ID (US)

(72) Inventors: Bradley Davis, Rathdrum, ID (US); William Tincup, Rathdrum, ID (US)

( * ) Notice: Subject to any disclaimer, the term of this patent is extended or adjusted under 35 U.S.C. 154(b) by 2 days.

(21) Appl. No.: 16/226,416

(22) Filed: Dec. 19, 2018

(65) Prior Publication Data

US 2020/0200500 A1 Jun. 25, 2020

(51) Int. Cl.
*F41A 21/36* (2006.01)

(52) U.S. Cl.
CPC ..... *F41A 21/36* (2013.01)

(58) Field of Classification Search
CPC ..... F41A 21/32; F41A 21/36; F41A 21/38
See application file for complete search history.

(56) References Cited

U.S. PATENT DOCUMENTS 2,558,200 A * 6/1951 Schmeling ..... F41A 21/40 42/79
2,770,904 A * 11/1956 Weiss ..... C07C 209/48 42/105
5,333,529 A * 8/1994 Brockman ..... F41A 21/38 42/79
5,425,298 A * 6/1995 Coburn ..... F41A 21/38 89/14.3
7,143,680 B2 * 12/2006 Bender ..... F41A 21/38 89/14.3

OTHER PUBLICATIONS

"ATLAS Compensator", https://www.odinworks.com/product_p/mb-atlas.htm (Year: 2016).*

* cited by examiner

*Primary Examiner* — Joshua T Semick
(74) *Attorney, Agent, or Firm* — Lee & Hayes, P.C.

(57) ABSTRACT

A side-discharge muzzle brake includes a body, which includes an attachment portion and multiple ports located in the wall of the body. The side-discharge muzzle brake further includes a sleeve sized to slide over a portion of the body and to be rotatable around the body. The sleeve includes multiple openings. The side-discharge muzzle brake includes a securing assembly that allows that sleeve to be rotatable around the portion of the body in two directions for a full 360 degrees of rotation.

18 Claims, 3 Drawing Sheets

ACTUATABLE MUZZLE BRAKE FOR A FIREARM

BACKGROUND

A muzzle brake is a device (e.g., an attachment) that attaches to a muzzle of a firearm. Typically, muzzle brakes are designed to reduce felt recoil that occurs when firing the firearm. Muzzle brakes reduce the felt recoil by venting expanding propellant gases in a direction transverse to the direction of extension of a barrel of the firearm through vents in the muzzle brake attachment located at the end of the barrel of the firearm. This results in the reduction of the felt recoil and consequently improves muzzle control.

However, muzzle brakes generally increase the volume of gas directed to the sides and rearward towards the shooter, resulting in a significant concussion affect. For this reason, a user may not desire to use the muzzle brake at a range, for example, when the user may be around other people who may have adverse reactions to the increased volume of gas directed toward the side and rear of the firearm. Therefore, the user may have to remove the muzzle brake while shooting at a range or around other people. On the other hand, the user may desire to use the same firearm for precise target shooting (e.g., shooting competition, hunting, etc.) and, having removed it for the range, would have to reinstall the muzzle brake. This may be undesirable because adding or removing a muzzle brake may significantly change the point of impact.

Thus, a solution is desired for a single muzzle brake device that may be implemented in a variety of different scenarios. Additionally, it is desired that such a solution would allow users to easily configure the muzzle brake device between different operating functions to accommodate the specific need.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the components on a larger scale or differently shaped for the sake of clarity.

DETAILED DESCRIPTION

As described previously, muzzle brakes benefit a user due to the reduced felt recoil the user may experience when firing a firearm with a muzzle brake. At the same time, muzzle brakes may increase the volume of gas redirected towards the shooter when the firearm is fired. This disclosure is directed to an actuatable muzzle brake (also referred to herein below as a "muzzle brake"). More specifically, the actuatable muzzle brake described herein may be actuated between multiple operating positions (or "modes"). For example, the muzzle brake may be operated in a first position, in which the muzzle brake vents combustion gas out a side of the muzzle brake when a firearm is fired, and a second position, in which the muzzle brake may prevent combustion gas from escaping out the side of the muzzle brake. In such an embodiment, the muzzle brake may be actuated between the first position and the second position while remaining installed on a firearm, thereby eliminating the need to remove and/or install the muzzle brake depending on the intended use.

Figure 1A:
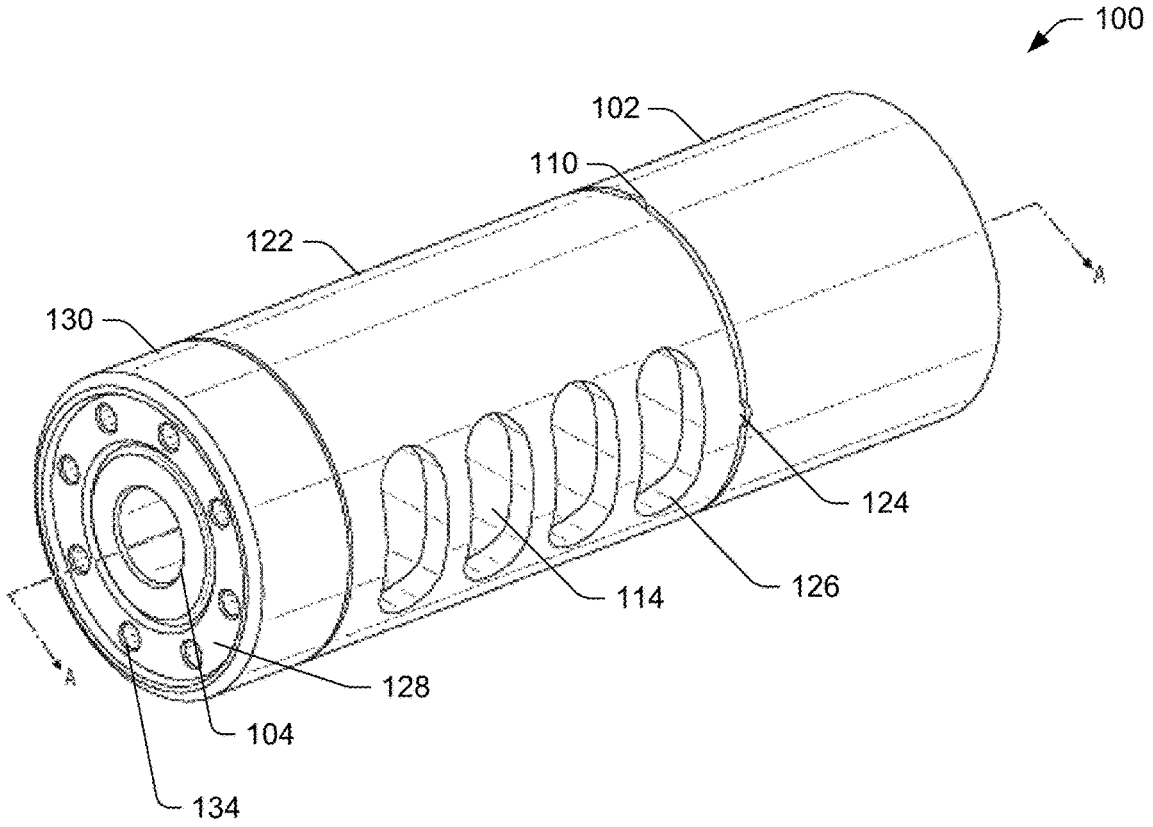
FIG. 1A illustrates a perspective view of an actuatable muzzle brake having a sleeve in a first position.
Figure 1B:
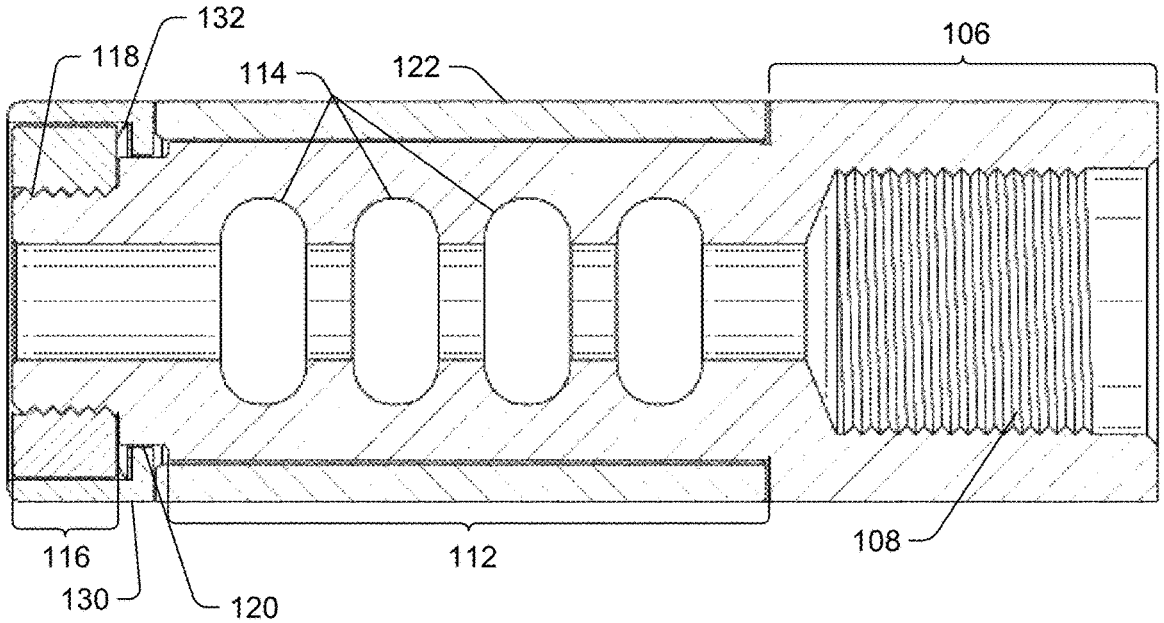
FIG. 1B illustrates a cross-sectional view of the actuatable muzzle brake taken across line A-A in FIG. 1.

FIG. 1A depicts a perspective view of an actuatable side-discharge muzzle brake 100 (referred to herein as a "muzzle brake"). In an embodiment, the muzzle brake 100 includes a body 102. The body 102 includes a hole 104 that extends through the body 102 along a length of the muzzle brake. The body 102 is described further with respect to FIGS. 1A and 1B. FIG. 1B depicts a cross-sectional view of the muzzle brake 100 taken along line A-A in FIG. 1. The muzzle brake 100 may also include a mounting portion 106 (also referred to herein as an "attachment portion"). In an embodiment, the mounting portion 106 may include internal threading 108 located in the hole 104 on a first end of the mounting portion 106 coinciding with a first end of the body 102. As shown in FIG. 1B, the mounting portion 106 may include internal threading 108 along a portion of the length of the mounting portion 106. However, in an alternative embodiment, the mounting portion 106 may include internal threading along the entire length of the mounting portion 106. The body 102 may also include multiple notches 110 located on a second end of the mounting portion 106 that is opposite the first end of the mounting portion 106. In an embodiment, the multiple notches 110 may include four notches located at 90 degree intervals. However, in an alternative embodiment, the muzzle brake 100 may include any number of notches located at any degree interval. In such an embodiment, the particular number and interval may be determined based at least in part on the type and/or size of vents (described further herein below).

The body 102 may further include a venting portion 112 that extends from the second end of the mounting portion 106. The vent portion 112 may include at least a pair of vents 114, and in an embodiment may include multiple vents 114 (referred to herein as "ports" or "vent apertures"), as shown in FIGS. 1A and 1B. In an embodiment, a first vent is disposed through a wall of the vent portion 112 into the hole 104 of the body 102 and a second vent (which cannot be seen as the second vent may be located on a far side of the muzzle brake in FIG. 1A) is disposed directly opposite the first vent through the wall of the vent portion 112 into the hole 104 in the body 102. The multiple vents 114 oriented in the wall of the vent portion 112 such that, when the muzzle brake 100 is attached to a firearm (not pictured), the multiple vents 114 are oriented on a horizontal plane to vent combustion gas substantially parallel to the horizontal plane.

The body 102 of the muzzle brake 100 may also include a threaded portion 116. The threaded portion 116 may extend from the vent portion 112 of the body 102. In an embodiment, the threaded portion 116 may include external threading 118 on a surface of the body 102 outside of the hole 104.

In an embodiment, the body 102 may include a shoulder 120 located between the vent portion 112 and the threaded portion 118.

The muzzle brake 100 may also include a sleeve 122. The sleeve 122 may be sized to slide over the vent portion 112 of the body 102. In an embodiment, the sleeve 122 may include multiple detents 124 located at an end of the sleeve 122. In such an embodiment, the multiple detents 124 may be sized to engage the multiple notches 110, respectively, such that the multiple detents 124 maintain a position of the sleeve 122. In such an embodiment, the multiple detents 124 may be located so as to correspond with the multiple notches 110. For example, if the body 102 includes four notches disposed at 90 degree intervals, then the sleeve may also include four detents disposed at 90 degree intervals. In an embodiment, both the multiple notches 110 and the multiple detents 124 may be substantially rounded such that the sleeve 122 may be rotatable when a rotational force is exerted on the sleeve 122. In such an embodiment, the multiple detents 124 may slide out of the multiple notches 110, thus pushing the sleeve 122 laterally away from the mounting portion 106 of the body 102.

Figure 2:
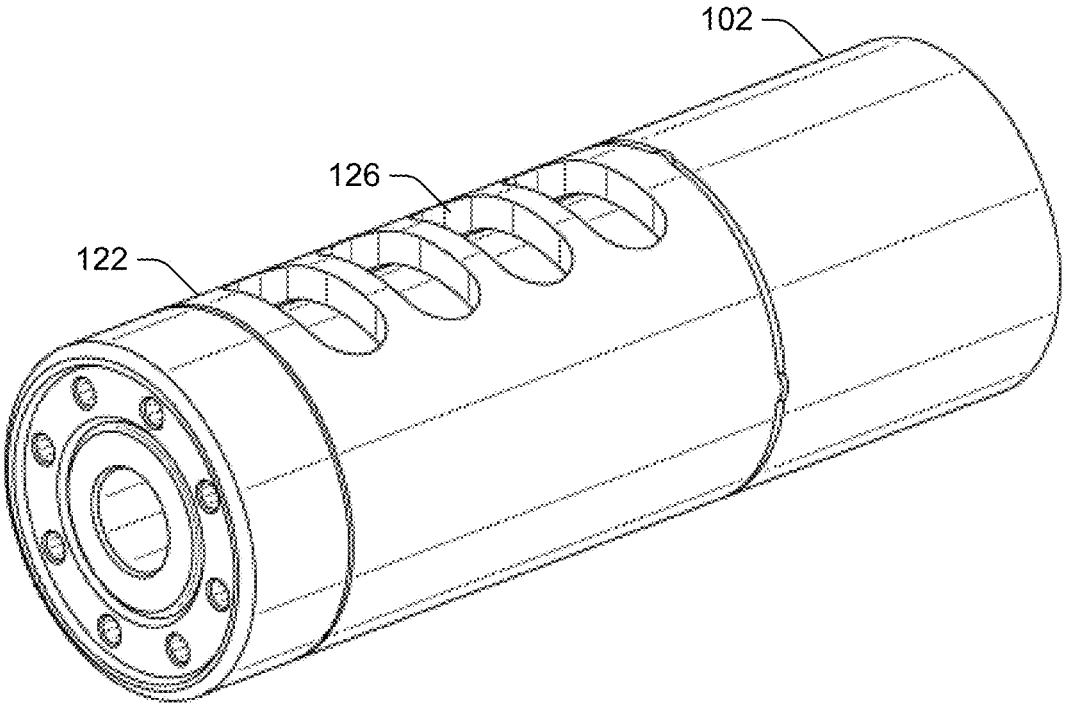
FIG. 2 illustrates a perspective view of the actuatable muzzle brake having a sleeve in a second position.

The sleeve 122 may also include at least a pair of exit apertures 126 (referred to herein as "apertures" or "openings"), and, in an embodiment, may include multiple apertures 126. The multiple apertures 126 may be disposed such that a first aperture 126 is disposed through a wall of the sleeve and a second aperture (which cannot be seen as the second vent may be located on a far side of the muzzle brake in FIG. 1A) is disposed opposite the first aperture through the wall of the sleeve 122. The multiple apertures 126 may be oriented in the wall of the sleeve 122 such that, when the sleeve 122 is rotated into a first position (as shown in FIG. 1A), the multiple apertures 126 are oriented to align with the multiple vents 114. The multiple apertures 126 may further be disposed in the wall of the sleeve 122 such that, when the sleeve is rotated into a second position (as shown in FIG. 2), the multiple apertures 126 are oriented to not align with the multiple vents 114 (described further herein below). Rather, the multiple vents 114 align with a continuous portion (i.e., unbroken, solid surface) of the sleeve 122, thus blocking combustion gas from escaping/venting out of the muzzle brake 100.

The muzzle brake 100 may further include a nut 128 that is removably attachable to the threaded portion 116 portion of the body 102 such that the nut maintains the sleeve 122 on the body 102. In an embodiment, the nut 128 may maintain the sleeve 122 on the body 102 such that the sleeve 122 is rotatable around the vent portion 112 of the body in two directions for a full 360 degrees of rotation (in both rotational directions) between the first position and the second position described above.

The muzzle brake 100 may further include a cover 130 that is sized to slide over the shoulder 120 and cover the threaded portion 116 of the body 102, such that the cover 130 is disposed adjacent to the second end of the sleeve 122. In such an embodiment, a first side of the cover 130 may abut a surface of the shoulder 120 of the body 102 and the sleeve 122. The muzzle brake 100 may also include at least one spring 132 disposed adjacent to a second side of the cover 130. In an embodiment, the spring 132 may be sized such that the spring 132 fits within the cover 130. The spring 132 may be positioned such that, when the nut is attached to the threaded portion 116 of the body 102, the nut 128 exerts a force on the spring 132 and the spring 132 exerts a compressive force on the cover 130 and the sleeve 122. In an embodiment, the spring 132 may include a compression spring. Such a spring may include a wave spring, the wave spring including any one of the following: single-turn wave spring, multi-turn wave spring, nested wave spring, a wave spring with shims, etc. In an embodiment, the compressive force exerted on the sleeve 122 by the spring 132 may maintain a position of the sleeve when the multiple detents 124 are engaged with the multiple notches 110. As mentioned previously, the multiple detents 124 and the multiple notches 110 may be substantially rounded such that the sleeve 122 is rotatable when a rotational force is exerted on the sleeve 122. For example, a rotational force may be applied to the sleeve 122 that exceeds a threshold force such that the rotational force overcomes the compressive force maintaining the position of the sleeve 122. In such an example, the sleeve 122 may move laterally, away from the mounting portion 106 of the body 102, such that the sleeve 122 pushes against the spring 132. The sleeve 122 may rotate around the vent portion 112 of the body 102 until the multiple detents 124 are forced into another set of respective multiple notches 110 by the compressive force of the spring.

In an embodiment, the cover 130 may include sidewalls that cover the spring 132 and the nut 128, as shown in FIGS. 1A and 1B. Because of this, the nut 128 may include multiple holes 134, as seen in FIG. 1A. The multiple holes 134 may correspond to a wrench (not shown in FIGS. 1A and 1B), having multiple posts that correspond with the multiple holes 134. The wrench having the multiple posts enables a user to assemble and disassemble the muzzle brake for cleaning, maintenance, and/or other purposes. The nut 128, cover 130, and the spring 132 may be referred to herein as a "securing assembly."

FIG. 2 depicts a perspective view of the muzzle brake 100 having the sleeve 122 in a second position. As mentioned previously, when the sleeve 122 of the muzzle brake 100 is in the second position, the multiple apertures 126 in the sleeve 122 are oriented to not align with the multiple vents (not seen in FIG. 2 since they are covered by the sleeve 122) such that a continuous portion of the sleeve 122 covers the multiple vents, thus blocking combustion gas from escaping/venting out of the muzzle brake 100. It is to be noted that in FIG. 2, the orientation of the body 102 has not changed, rather, the sleeve 122 has been rotated relative to the body 102.

Figure 3:
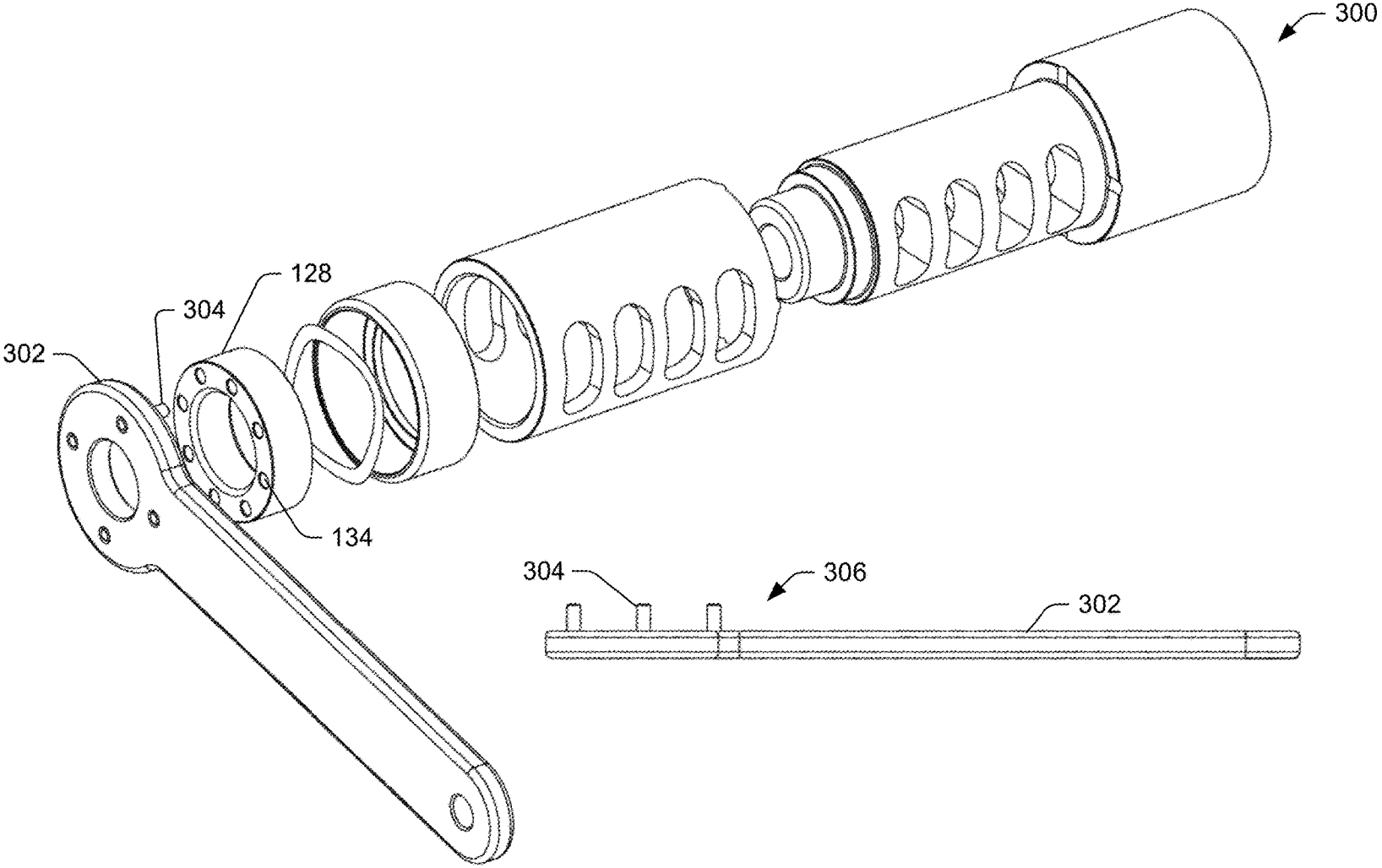
FIG. 3 illustrates an exploded view of the actuatable muzzle brake.

FIG. 3 depicts an exploded view of a muzzle brake 300, as shown and described in FIGS. 1-2. FIG. 3 depicts possible locations and orientations of each of each of the components previously described. FIG. 3 further depicts a wrench 302 as previously described. The wrench 302 may include multiple posts 304 that correspond with the multiple holes 134 of the nut 128. The wrench 302 having the multiple posts 304 enables a user to assemble and disassemble the muzzle brake for cleaning, maintenance, and/or other purposes. FIG. 3 also depicts a side profile 306 view of the wrench 302 and the multiple posts 304.

CONCLUSION

Although embodiments have been described in language specific to structural features and/or methodological acts, it is to be understood that the disclosure is not necessarily limited to the specific features or acts described. Rather, the specific features and acts are disclosed herein as illustrative forms of implementing the claimed subject matter.

What is claimed is:

1. A muzzle brake comprising:

a body having a hole that extends through the body in a lengthwise direction, the body including:

a mounting portion including internal threading in the hole on a first end of the mounting portion coinciding with a first end of the body, a plurality of notches located on a second end of the mounting portion that is opposite the first end of the mounting portion, a vent portion extending from the second end of the mounting portion, the vent portion including at least a pair of vent apertures disposed such that a first vent aperture is disposed through a wall of the vent portion into the hole in the body and a second vent aperture is disposed opposite the first vent aperture through the wall of the vent portion into the hole in the body, the pair of vent apertures oriented in the wall of the vent portion such that, when the muzzle brake is attached to a firearm, the pair of vent apertures are oriented on a horizontal plane to vent combustion gas substantially parallel to the horizontal plane, a threaded portion extending from the vent portion, the threaded portion including external threading on a surface of the body outside the hole, and a shoulder between the vent portion and the threaded portion;

a sleeve sized to slide over the vent portion of the body, the sleeve including:

a plurality of detents located at an end of the sleeve and sized to engage the plurality of notches, respectively, such that the plurality of detents maintains a position of the sleeve, and at least a pair of exit apertures disposed such that a first exit aperture is disposed through a wall of the sleeve and a second exit aperture is disposed opposite the first exit aperture through the wall of the sleeve, the pair of exit apertures oriented in the wall of the sleeve such that:

when the sleeve is rotated into a first position, the pair of exit apertures are oriented to align with the pair of vent apertures, and when the sleeve is rotated into a second position, the pair of exit apertures are oriented to not align with the pair of vent apertures; and a nut that is removably attachable to the threaded portion of the body such that the nut maintains the sleeve on the body, wherein the sleeve is rotatable about the vent portion of the body in two directions for a full 360 degrees of rotation between the first position and the second position.

2. The muzzle brake according to claim 1, wherein the plurality of notches include four notches located at 90 degree intervals.

3. The muzzle brake according to claim 1, wherein the plurality of detents include four detents located at 90 degree intervals so as to correspond with the plurality of notches.

4. The muzzle brake according to claim 1, wherein when the sleeve is rotated into the second position, the pair of exit apertures align with a continuous portion of the sleeve such that the sleeve prevents combustion gas from venting through the vent apertures.

5. The muzzle brake according to claim 1, wherein the end of the sleeve is a first end, and the sleeve has a second end opposite the first end of the sleeve, and wherein the muzzle brake further comprises:

a cover sized to slide over the shoulder and cover the threaded portion of the body, such that the cover is disposed adjacent to the second end of the sleeve; and a spring disposed in the cover such that, when the nut is attached to the threaded portion of the body, the nut exerts a force on the spring and the spring exerts a compressive force on the sleeve.

6. The muzzle brake according to claim 5, wherein the spring is a compression spring.

7. The muzzle brake according to claim 5, wherein the spring is a wave spring.

8. The muzzle brake according to claim 5, wherein the compressive force maintains a position of the sleeve when the plurality of detents are engaged in the plurality of notches.

9. The muzzle brake according to claim 8, wherein the plurality of detents are substantially rounded and the plurality of notches are substantially rounded such that the sleeve is rotatable when an applied rotational force is exerted on the sleeve, and wherein the applied rotational force exceeds a threshold rotational force such that the rotational force overcomes the compressive force maintaining the position of the sleeve, thus pushing the sleeve laterally away from the mounting portion of the body.

10. A side-discharge muzzle brake comprising:

a body having a hole that extends through the body in a lengthwise direction, the body including:

an attachment portion including internal threading in the hole on a first end of the attachment portion coinciding with a first end of the body and multiple notches located on a second end of the attachment portion that is opposite the first end of the attachment portion, and multiple ports located through a wall of the body, the multiple ports located in the wall of the body, such that, when the side-discharge muzzle brake is attached to a firearm, the multiple ports are oriented on a horizontal plane to vent combustion gas in a direction that is substantially parallel to the horizontal plane;

a sleeve sized to slide over at least a portion of the body and to be rotatable around the body, the sleeve including multiple openings and multiple detents configured to be insertable into the multiple notches such that the multiple detents maintain a position of the sleeve unless a rotatable force is applied to the sleeve, the rotatable force exceeding a threshold force in order to rotate the sleeve concentrically around the body; and a securing assembly configured to secure the sleeve on the body of the side-discharge muzzle brake, such that the sleeve is rotatable about the portion of the body in two directions for a full 360 degrees of rotation.

11. The side-discharge muzzle brake according to claim 10, wherein the securing assembly includes:

a cover disposed adjacent to a first end of the sleeve, the cover sized to slide onto the body such that the cover covers a threaded portion that extends from the body of the side-discharge muzzle brake;

a spring disposed in the cover; and a nut configured to attach to the threaded portion of the body, wherein the nut attaches to the body such that the nut exerts a force on the spring and the spring exerts a compressive force on the cover and the sleeve.

12. The side-discharge muzzle brake according to claim 11, wherein the threaded portion is located on a second end of the body, the second end of the body being opposite the first end of the body.

13. The side-discharge muzzle brake according to claim 10, wherein the sleeve is rotatable into a first position, the first position including a position wherein the multiple openings in the sleeve align with the multiple ports in the body to vent combustion gas.

14. The side-discharge muzzle brake according to claim 10, wherein the sleeve is rotatable into a second position, the second position including a position wherein the sleeve is arranged such that a continuous portion of the sleeve covers the multiple ports in the body to prevent combustion gas from escaping the side-discharge muzzle brake.

15. The side-discharge muzzle brake according to claim 11, wherein the sleeve is rotatable when a rotatable force is exerted on the sleeve that overcomes the compressive force maintaining a position of the sleeve.

16. An actuatable muzzle brake comprising:

a body including:

one or more vents configured to vent combustion gas, and one or more notches located on a lip of the body; and a rotatable sleeve configured to slide over at least a portion of the body, the sleeve including:

one or more apertures configured to align with the one or more vents in a first position, the one or more apertures being sized such that a continuous portion of the sleeve completely covers the one or more vents in a second position, and one or more detents configured to engage with the one or more notches such that the one or more detents maintain a position of the sleeve unless a rotatable force is applied to the sleeve, the rotatable force exceeding a threshold force in order to rotate the sleeve concentrically around the body, wherein the one or more vents are oriented substantially parallel to a horizontal plane when the actuatable muzzle brake is installed on a firearm, such that the actuatable muzzle brake discharges combustion gas out sides of the actuatable muzzle brake.

17. The actuatable muzzle brake according to claim 16, wherein the one or more notches are disposed on the lip of the body at 90 degree intervals and the one or more detents are disposed on the sleeve at 90 degree intervals, such that the sleeve is rotatable in two directions for a full 360 degrees of rotation.

18. The actuatable muzzle brake according to claim 16, wherein the actuatable muzzle brake further comprises:

a cover disposed adjacent to a first end of the sleeve, the cover sized to slide onto the body such that the cover covers a threaded portion that extends from the body of the actuatable muzzle brake;

a spring disposed in the cover; and a nut configured to attach to the threaded portion of the body, the nut attaching to the body such that the nut exerts a force on the spring and the spring exerts a compressive force on the cover and the sleeve, wherein the rotatable force overcomes the compressive force that maintains the one or more detents in the one or more notches.

* * * * *